United States Patent [19]

Gali Mallofre

[11] 4,212,597

[45] Jul. 15, 1980

[54] PNEUMATIC INSTALLATIONS

[76] Inventor: Salvador Gali Mallofre, Londres, 29, Barcelona, Spain

[21] Appl. No.: 920,354

[22] Filed: Jun. 29, 1978

[30] Foreign Application Priority Data

Mar. 22, 1978 [ES] Spain ..... 468.200

[51] Int. Cl.[2] ..... F04B 17/00

[52] U.S. Cl. ..... 417/225; 417/396; 91/319

[58] Field of Search ..... 417/396, 404, 225; 91/319

[56] References Cited

U.S. PATENT DOCUMENTS

| | | | |
|---|---|---|---|
| 2,296,647 | 9/1942 | McCormick | 417/225 X |
| 2,708,412 | 5/1955 | Mueller | 417/225 |
| 2,826,149 | 3/1958 | Wrigley | 417/225 |
| 2,942,553 | 6/1960 | Moeller et al. | 417/396 |
| 2,977,040 | 3/1961 | Dulebohn et al. | 417/225 |

FOREIGN PATENT DOCUMENTS

| | | | |
|---|---|---|---|
| 2254048 | 7/1974 | Fed. Rep. of Germany | 91/319 |

*Primary Examiner*—Richard E. Gluck
*Attorney, Agent, or Firm*—Wenderoth, Lind & Ponack

[57] ABSTRACT

In thrust chambers of a recompressor piston are arranged ports which are joined to conduits leading to opposite fronts of the distributor piston of a five way valve. Flow passages lead to thrust chambers provided with conduits which, through a unidirectional valve, penetrate along the interior of a coaxial stem to the recompressor piston, and constitute fixed variators of the volume in the recompression chambers when the recompressor piston is cyclically displaced.

5 Claims, 1 Drawing Figure

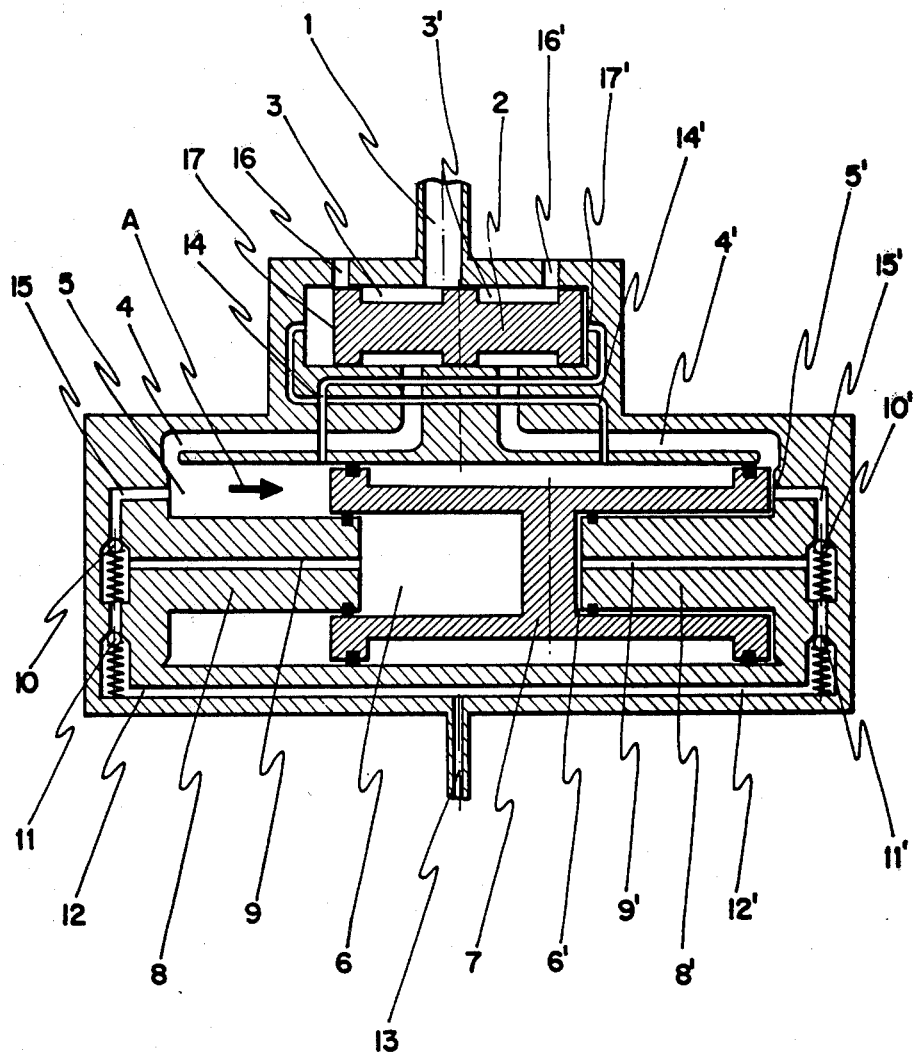
1
3'
16'
17'
3
2
14'
17
16
5'
A
14
4'
15'
15
5
4
10'
10
11
11'
12
9
9'
12'
8
6
7
6'
8'
13

PNEUMATIC INSTALLATIONS

BACKGROUND OF THE INVENTION

The present invention is directed to an improvement in a pneumatic installation which supplies a desired fluid pressure through an outlet flow passage of a fluid pressure distribution network. The improvement consists of having a pneumatic device having a compressed fluid feed inlet which branches into two opposed recompression chambers. There is a two part piston located within the two opposed recompression chambers for reciprocatingly moving therein, each part of the piston having other independent opposed thrust chambers located in its sleeve so that when one of these chambers is activated, i.e. receiving fluid, the other is inoperative.

The described opposed recompression and thrust chambers are controlled by a common distributor, the automatic activation of which is determined by end of stroke valves which are located in the opposed recompression chambers of the two part piston and serve to connect the compressed fluid feed inlet to the front of the recompression chamber which has the back enclosed by a wall or stem of the two part piston which connects the two parts of the piston and separates the opposed recompression chambers from each other. The end of stroke valves additionally serve to connect the compressed fluid feed inlet to a conduit.

The distributor connected to the exterior is composed of a conventional five way chamber which connects two passages or ports to each one of the chambers on the same side, one of the passages or ports being a control conduit and the other a thrust flow passage.

The thrust flow passage branches, in turn, into two passages, one of which has a smaller cross section and is provided with a unidirectional valve which leads to the recompression chamber, while the other passage is free and leads to the thrust chamber.

The distributor is likewise provided with ports for evacuating the contents of the inoperative thrust chamber, while each one of the recompression chambers is provided with corresponding outlet conduits which corporate a unidirectional valve, the two conduits of the described recompression chambers being joined at a common outlet which also makes up the outlet passage for recompression air.

With the previously described improvements, there is arranged at the base of the pneumatic machine a compressed fluid tank wherein the fluid is kept at a constant pressure thus eliminating the requirement of having to place a pressurized fluid supply for the tank near to the machine in operation and thus the tank in combination with the pneumatic device is, in effect, a compressed air generator. Therefore, the object of this invention is to supply pressurized fluid for use in mining operations, specifically in galleries, since it does not consume atmospheric air and is, in addition, explosionproof.

However, it has been shown in practice that the end of stroke valves which cause the recompression cyclic action, are subject to breakdown and are even prematurely activated when, due to the wear on the springs, they are compressed by the pressure reached in the recompression chamber.

SUMMARY OF THE INVENTION

With this problem in mind, the object of the present invention resides in improvements which consist of substituting the end of stroke valves with control conduits which are strategically situated in the thrust chambers and are alternatively opened by the recompression piston at the ends of the stroke thereof, so that the inlet air alternatively displaces the distributor which causes cyclic operation of the device.

This this modification or improvement the thrust chamber receives compressed air until the displacement thereof opens the control ports, thereby insuring that the recompression chamber has reached the pressure necessary to overcome the counterpressure opposing the tank fluid pressure.

The aforementioned improvement involves a modification of the recompressor piston so that in its reciprocating movement, produces a corresponding reciprocating opening and closing of the ports. Thus, the modification of the recompression piston is structural in nature and not a difference in positioning of the piston, since the two chambers on each side, a thrust and a recompression chamber, are maintained in the assembly.

However, the recompressor piston has two chambers having specific volumes, which make up the two recompression chambers.

Another important modification to the recompressor piston is that conventional sliding guides have been displaced toward each of the ends while still having the independent and opposed thrust chambers formed in the housing guide thereof.

A further modification for the activation of the distributor, as previously described, is the provision of two control conduits which are activated by the piston through an annular recess in the side surface thereof. The recess forms the guides for the piston which makes up the thrust heads for the thrust chambers which are in turn composed of the sleeve of the piston and the bases of the piston which serve to close the sleeve at its ends.

The bases which close the ends of the sleeves abut at stems which, being opposed, adjust to each one of the recompression chambers of the cylinder, so that each one of the stems is provided with a longitudinal conduit which ends between two opposed unidirectional valves, one of which is an inlet valve and the other a recompression outlet valve. The inlet valve is connected to the corresponding thrust chamber which, in turn, is connected, through the distributor, to the inlet. The recompression outlet valve connects to an outlet which is common to the other valve which has a like function with the outlet being connected to the tank wherein the recompressed fluid is stored.

The five way valve performs the distribution produced by continuous functioning of the assembly, provided that the recompressed fluid tank is in a condition for receiving air. Naturally, this occurs when one or more machines in operation are connected to the tank. Likewise, the described five way valve incorporates two opposed control conduits, two opposed thrust flow passages, and two opposed exhaust ports, so that the opposed control conduits are connected to the ports which open into the recompressor piston and communicate directly with the respective front walls of the distributor piston, while the thrust flow passages connect the chamber of the distributor with each one of the thrust chambers of the recompressor piston, so that, through openings which are provided at the bases of the piston which serve to close the sleeve at its ends, they are connected to the respective inlet valves.

The thrust flow passages described are independent and are cyclically operative, through the respective exhaust ports, with the distributor piston, thereby facilitating the recompression or permitting the emptying of the corresponding thrust chamber.

According to the aforegoing, the improvements described in this invention consist of arranging, in the thrust chambers of the recompressor piston, two ports which are connected to opposed conduits which lead to opposite front walls of the distributor piston which makes up the five way valve, with the thrust flow passages leading to the thrust chambers which are provided with additional passages which, through a unidirectional valve, pass through the interior of a coaxial stem to the recompressor piston, while being housed in chambers which are provided in the described recompressor piston, thereby making up a fixed protrusion for varying the volume in the recompression chambers when the recompressor piston is reciprocatingly displaced in a cyclical manner.

Each one of the fixed protrusions, determined by stems, connect the recompression chambers, through the passages, with the unidirectional recompression valves which open oppositely to the inlet valves, which likewise communicate through the passages which lead to a common intake tank flow passage which connects with the tank in which the compressed fluid is stored.

In this way, at the end of a stroke of the piston, in each one of the displacement directions, the corresponding control conduit opens which in turn connects to the front of the head of the distributor and there opposes the inlet fluid and causes displacement of the distributor piston thereof, and connects the thrust flow passage corresponding to the opposite thrust chamber to the exhaust port.

The recompression valve of one of the recompression chambers acts simultaneously, being opened when the inlet valve of the opposite recompression chambers is opened, while the thrust flow passage of the thrust chamber of the same side where the recompression valve is open communicates with the exhaust port.

BRIEF DESCRIPTION OF THE DRAWING

To complement the description and operation of the device which will be subsequently made, and for a better understanding of the elements of the invention, a sheet of drawings is attached hereto which is a schematic longitudinal sectional view of the pneumatic device of the present invention.

DETAILED DESCRIPTION OF THE INVENTION

According to the drawing and the following description, the functioning of the device is as follows:

The air coming from the network or a compressor located at a great distance from the device, enters through the compressed fluid feed inlet 1 and, through the distribution chamber 3, reaches the thrust flow passage 4 which, at this moment, acts as an inlet passage, and enters into the thrust chamber 5, so that when full it displaces the recompressor piston 7 in the direction indicated by arrow A.

Simultaneoulsy, the fluid passes through the by-pass 15 and opens valve 10, so that as a result of the recompression valve 11 being closed, it passed through the recompression passage 9 into the recompression chamber 6.

It is important to point out that the recompression valve 11 is maintained closed due to the compressed air in the tank, the pressure of which is higher than that of the inlet air which is present in conduit 12 and passage 13.

When the thrust chamber 5 is full, the recompression chamber 6 will also be full, at this instant, as shown in the figure, the control passage 14 is opened and the inlet fluid passes from the thrust chamber 5 through the control passage to the front wall 17' of the distributor piston 2, moving it to a position opposite to that shown in the figure.

Simultaneously, the inlet fluid which continues to enter through the inlet 1 passes through the distribution chamber 3' to the reversible thrust flow passage 4' which acts at this time as an inlet for allowing the fluid to reach the thrust chamber 5' and therefrom, through the by-pass 15', opens the inlet valve 10', to the recompression passage 9', which runs through the protrusion 8', and enters the corresponding recompression chamber 6'.

When this occurs, the recompression piston 7 is displaced in a direction contrary to that indicated by arrow A and, consequently, the fluid contained in the thrust chamber 5 is discharged through the reversible thrust flow passage 4 which acts as an exhaust passage so that it passes, through the distribution chamber 3, to the exhaust port 16.

While this is occuring, the air contained in the recompression chamber 6 is ejected by the displacement of piston 7 which, in turn, is pushed by the air entering the recompression chamber 6' and the thrust chamber 5'.

The injected air then passes, through the recompression passage 9, to the valve 10 closing it, where the described injected air is accumulated until the pressure reached is greater than the counter-pressure which, coming from the tank, tends to maintain the unidirectional recompression valve 11 closed. At this time the described valve 11 is opened and the recompressed air passes through the tank flow conduit 12 to the tank flow passage 13 and from the tank flow passage to the tank where it is stored.

When the recompressor piston 7 reaches the end of its stroke, it opens the control conduit 14' so that the inlet fluid passes from the thrust chamber 5' to the thrust front 17 of the distributor piston 2, which will then be moved to occupy the position as shown in the drawing, initiating in this manner a new cycle.

This cyclic functioning is continuous and automatic while the tank (not shown) to which the air passes through the collector 13, admits air when there is a discharge caused by the consumption of air by a machine in operation, so that when the machine is inoperative, the tank is full and the recompressor stops operating.

Naturally, the recompressor also stops when fluid no longer enters through the compressed fluid feed inlet 1, that is to say when the network is not being charged or when the main generator is inoperative.

Thus, it becomes clear that the pneumatic device according to the present invention, not only produces a source of air at the operating site for powering pneumatic machines but additionally continuously contributes fresh air to the atmosphere of the site. This device is remarkably good for use in excavation working sites, both in a closed gallery as well as on the surface because it eliminates the risk of producing an explosive mixture with possible gas fumes at such sites.

I claim:

1. A pneumatic device for regulating a flow of compressed fluid to a compressed fluid tank, said tank being used to supply compressed fluid for powering pneumatic machinery and being recompressed by compressed fluid from said device, said device comprising:

a valve housing having a fluid feed inlet, first and second exhaust ports, first and second reversible thrust flow ports, and first and second control ports;

a control piston reciprocatingly slidably mounted within said valve housing, said control piston having a shape for defining with said valve housing first and second opposed chambers at opposite ends of said control piston, and said piston further having first and second distribution chambers for alternately defining passages between said fluid feed inlet and said first and second reversible thrust flow ports, and dimensioned such that when one of said thrust flow ports communicates with said fluid feed inlet, the other of said thrust flow ports communicates with a corresponding one of said exhaust ports, said opposed chambers having said control ports located correspondingly communicating therewith;

a recompression housing having first and second thrust chambers and first and second protrusions at opposite ends thereof, said protrusions having recompression passages therein which communicate with said first and second thrust chambers, respectively, said recompression passages having one way valves therein for allowing fluid flow from said thrust chambers to said recompression passages, said recompression housing having a single outlet conduit leading from said recompression housing, said recompression housing further having first and second tank flow passages respectively connecting said first and second recompression passages with said outlet conduit, said tank flow passages having tank one way valves for allowing fluid flow from said recompression passages to said single outlet conduit;

a recompression piston reciprocatingly slidably mounted within said recompression housing, said recompression piston having a shape whereby said thrust chambers are located at opposite ends thereof, said piston being supported by said protrusions and further shaped for cooperating with said protrusion for defining therewith first and second recompression chambers, each of said recompression chambers communicating with a respective recompression passage;

first and second reversible thrust flow passages connecting said first and second thrust flow ports, respectively, with said first and second thrust chambers;

first and second control passage, connecting said first and second opposed chambers, at said control ports, with said second and first thrust chambers, respectively, only one of said control passages being open at a time according to the position of said recompression piston within said recompression housing; and whereby all of the above elements cooperate so that when compressed fluid is fed through said fluid feed inlet, said fluid passes through one of said control piston distribution chambers, which defines one of said distribution passages to said first reversible thrust flow passage and into said first thrust chamber and further passes, through said corresponding recompression passage one way valve and recompression passage, into said first recompression chamber, thereby displacing said recompression piston in a first direction and thereby causing compressed fluid in said second thrust chamber and recompression chamber to be expelled through corresponding reversible thrust flow and recompression passages, said fluid in said second thrust chamber passing out through said second exhaust port and said fluid in said second recompression chamber passing through said corresponding recompression passage to said corresponding tank passage valve and further, through said corresponding tank passage to said outlet conduit and therefrom to said compressed air tank, simultaneously, said recompression piston opening said first control passage as a result of said recompression piston movement, and compressed fluid flowing through said first control passage for causing said control piston to move, for causing the elements opposite to those recited cooperating elements to cooperate in the same manner as recited, the operation of said device being cyclical and continuous.

2. A penumatic device as claimed in claim 1, wherein said control piston further comprises: A stem which is shaped for alternately allowing compressed fluid to flow from said feed inlet to said corresponding one said reversible thrust flow passages while allowing fluid to flow from said corresponding other reversible thrust flow passage out through corresponding ones of said exhaust ports, said stem having front walls at each end for having pressure exerted thereon for causing said control piston to reciprocatingly move within said valve housing.

3. A pneumatic device as claimed in claim 1 or 2 wherein said first control passage connects said first thrust chamber to said valve housing at said second one of said opposed chamber located at said ends of said control piston, and said second control passage connects said second thrust chamber to said valve housing at said first opposed passage for causing continuous and automatic operation of said device.

4. A pneumatic device as claimed in claim 1 or 2 wherein corresponding ones of said recompression passage valves is open when corresponding ones of said tank flow passage valves of correspondingly opposite recompression passages is open while said reversible thrust flow passage of said thrust chambers, corresponding to said same side of said open recompression passage valves, communicates with corresponding ones of said exhaust ports.

5. A pneumatic device as claimed in claim 3 wherein corresponding ones of said recompression passage valves is open when corresponding ones of said tank flow passage valves of correspondingly opposite recompression passages is open while said reversible thrust flow passage of said thrust chambers, corresponding to said same side of said open recompression passage valves, communicates with corresponding ones of said exhaust ports.

* * * * *